US010255798B2

(12) United States Patent
Li et al.

(10) Patent No.: US 10,255,798 B2
(45) Date of Patent: Apr. 9, 2019

(54) DROWNING ALARM SYSTEM AND DROWNING ALARM METHOD

(71) Applicant: BOE TECHNOLOGY GROUP CO., LTD., Beijing (CN)

(72) Inventors: Xiaoyu Li, Beijing (CN); Lihua Geng, Beijing (CN); Han Yan, Beijing (CN); Pablo Navarrete Michelini, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/805,327

(22) Filed: Nov. 7, 2017

(65) Prior Publication Data

US 2018/0197405 A1 Jul. 12, 2018

(30) Foreign Application Priority Data

Jan. 6, 2017 (CN) ..... 2017 1 0009887

(51) Int. Cl.

*G08B 29/18* (2006.01)
*G08B 21/08* (2006.01)
*G08B 21/02* (2006.01)

(52) U.S. Cl.

CPC ..... *G08B 29/185* (2013.01); *G08B 21/0233* (2013.01); *G08B 21/08* (2013.01); *G08B 21/088* (2013.01)

(58) Field of Classification Search

CPC ..... G08B 29/185
See application file for complete search history.

(56) References Cited

U.S. PATENT DOCUMENTS

2010/0121226 A1 5/2010 Ten Kate et al.
2016/0005292 A1 1/2016 Carroll
2016/0314675 A1* 10/2016 Hawsah ..... G08B 21/088

FOREIGN PATENT DOCUMENTS

CN 101711401 A 5/2010
CN 203606927 U 5/2014

(Continued)

OTHER PUBLICATIONS

Chinese Search Report issued by the Chinese Patent Office dated May 9, 2017.

(Continued)

*Primary Examiner* — Leon Flores
(74) *Attorney, Agent, or Firm* — Dilworth & Barrese, LLP.; Michael J. Musella, Esq.

(57) ABSTRACT

A drowning alarm system and a drowning alarm method. The drowning alarm system includes a submerging detection device, a position detection device and a signal transmitting device. The submerging detection device configured to detect whether or not the submerging detection device is submerged, and generate a submerging alarm instruction when the submerging detection device is submerged. The position detection device configured to determine whether or not the submerging detection device is within a preset range, and generate a distance information instruction when the submerging detection device is within the preset range. The signal transmitting device configured to transmit a first alarm signal when the submerging detection device generates the submerging alarm instruction and the position detection device generates the distance information instruction. The drowning alarming system with false alarm prevention function is realized.

20 Claims, 4 Drawing Sheets

(56) References Cited

FOREIGN PATENT DOCUMENTS

| | | | |
|---|---|---|---|
| CN | 104134317 | A | 11/2014 |
| CN | 1052085991 | A | 12/2015 |
| CN | 105279901 | A | 1/2016 |
| CN | 106097659 | A | 11/2016 |

OTHER PUBLICATIONS

First Chinese Office Action dated Jul. 14, 2017.
Second Chinese Office Action dated Oct. 30, 2017.

* cited by examiner

| Identifier of Sensing Unit | Identifier of Alarm Type |
| --- | --- |

DROWNING ALARM SYSTEM AND DROWNING ALARM METHOD

TECHNICAL FIELD

Embodiments of the present disclosure relate to a drowning alarm system and a drowning alarm method.

BACKGROUND

Swimming is one of the most popular sports, but swimming drowning events often occur due to lack of timely detection and rescue of a drowning man. In order to decrease a possibility of the swimming drowning events, researchers have designed a plurality of drowning alarm systems, for example, drowning alarm systems based on ultrasonic detection, radar detection, camera monitoring, posture detection and acceleration detection. The above-mentioned systems determine whether or not there is drowning event mainly according to some gesture and speed characteristics of swimmers experiencing drowning. However, for drowning alarm systems based on gesture determination, false alarm events can be triggered by non-drowning event (for example, swimmers play in a swimming pool). In addition, some drowning alarm systems require the swimmer to wear a detection device such as a bracelet and a ring. Due to the wearing of the bracelet, the ring or other detection devices, not only the swimming experience of the swimmer can be affected but also the false alarm events caused by the dropping of the detection device (for example, the bracelet) can be occurred. The false alarm events not only make a rescuer fatigue but also affect the rescue of the drowning man truly in need. Therefore, a drowning alarm system with false alarm prevention function is needed.

SUMMARY

An embodiment of the present disclosure provides a drowning alarm system, which comprises: a submerging detection device configured to detect whether or not the submerging detection device is submerged, and generate a submerging alarm instruction when the submerging detection device is submerged; a position detection device configured to determine whether or not the submerging detection device is within a preset range, and generate a distance information instruction when the submerging detection device is within the preset range; and a signal transmitting device configured to transmit a first alarm signal when the submerging detection device generates the submerging alarm instruction and the position detection device generates the distance information instruction.

For example, in the drowning alarm system provided by an embodiment of the present disclosure, detecting of whether or not the submerging detection device is submerged and generating of the submerging alarm instruction when the submerging detection device is submerged comprises: generating a first submerging alarm instruction when a total time for a state of the submerging detection device being submerged in a submerging detection period is greater than a first time threshold; and/or generating a second submerging alarm instruction when a time, for which the submerging detection device has been continuously submerged, is greater than a second time threshold.

For example, in the drowning alarm system provided by an embodiment of the present disclosure, the position detection device is further configured to be in a working mode when the submerging detection device generates the submerging alarm instruction.

For example, in the drowning alarm system provided by an embodiment of the present disclosure, the position detection device is further configured to determine whether or not the submerging detection device is within the preset range at set intervals.

For example, in the drowning alarm system provided by an embodiment of the present disclosure, the position detection device comprises a first position detection sub-device and a second position detection sub-device; the submerging detection device is fixedly connected with the first position detection sub-device or the second position detection sub-device; and the position detection device is configured to determine whether or not the submerging detection device is within the preset range according to a distance between the first position detection sub-device and the second position detection sub-device.

For example, in the drowning alarm system provided by an embodiment of the present disclosure, further comprises a swimming goggle and a nose clip, the first position detection sub-device is disposed on the swimming goggle; and the second position detection sub-device is disposed on the nose clip.

For example, in the drowning alarm system provided by an embodiment of the present disclosure, the signal transmitting device is further configured to transmit a second alarm signal when the submerging detection device is out of the preset range.

For example, in the drowning alarm system provided by an embodiment of the present disclosure, further comprises a signal receiving device, the signal receiving device is configured to receive the first alarm signal.

For example, in the drowning alarm system provided by an embodiment of the present disclosure, the signal receiving device comprises a first signal receiving sub-device and a second signal receiving sub-device; the first signal receiving sub-device comprises a plurality of sensing units; and signal transfer between at least one sensing unit and the second signal receiving sub-device is realized through wireless communication or wired communication.

For example, in the drowning alarm system provided by an embodiment of the present disclosure, further comprises a control device, the plurality of sensing units are arranged in an array; and the second signal receiving sub-device receives a signal transmitted by the at least one sensing unit, and relays the signal received to the control device.

For example, in the drowning alarm system provided by an embodiment of the present disclosure, further comprises a control device, the control device is configured to determine a position of the submerging detection device according to intensities of the first alarm signal received by the plurality of sensing units of the first signal receiving sub-device.

For example, in the drowning alarm system provided by an embodiment of the present disclosure, further comprises an alarm signal output device, the alarm signal output device is configured to output alarm information.

For example, in the drowning alarm system provided by an embodiment of the present disclosure, the position detection device is configured to determine whether or not the submerging detection device is within the preset range by determining whether or not the submerging detection device is within a preset range of a predetermined setting position of the submerging detection device.

Another embodiment of the present disclosure provides a drowning alarm method, which comprises: detecting whether or not the submerging detection device is submerged, and generating a submerging alarm instruction when the submerging detection device is submerged; determining whether or not the submerging detection device is within a preset range, and generating a distance information instruction when the submerging detection device is within the preset range; and transmitting a first alarm signal in a case that both the submerging alarm instruction and the distance information instruction are generated.

For example, in the drowning alarm method provided by another embodiment of the present disclosure, detecting of whether or not the submerging detection device is submerged and generating of the submerging alarm instruction when the submerging detection device is submerged comprises: generating a first submerging alarm instruction when a total time for a state of the submerging detection device being submerged in a submerging detection period is greater than a first time threshold; and/or generating a second submerging alarm instruction when a time, for which the submerging detection device has been continuously submerged, is greater than a second time threshold.

For example, in the drowning alarm method provided by another embodiment of the present disclosure, whether or not the submerging detection device is within the preset range is determined when the submerging detection device generates the submerging alarm instruction.

For example, in the drowning alarm method provided by another embodiment of the present disclosure, further comprises: transmitting a second alarm signal when the submerging detection device is out of the preset range.

For example, in the drowning alarm method provided by another embodiment of the present disclosure, further comprises: receiving the first alarm signal, and determining a position of a drowning man according to intensities of the first alarm signal received.

For example, in the drowning alarm method provided by another embodiment of the present disclosure, further comprises: outputting alarm information in a case that the first alarm signal is transmitted.

Further another embodiment of the present disclosure provides a drowning alarm system, which comprises a submerging detection device, a position detection device, a signal transmitting device, a processor, a memory and computer program instructions stored in the memory, upon the processor running the computer program instructions, the drowning alarm system performs the following method comprises: detecting whether or not the submerging detection device is submerged, and generating a submerging alarm instruction when the submerging detection device is submerged; determining whether or not the submerging detection device is within a preset range, and generating a distance information instruction when the submerging detection device is within the preset range; and adopting the signal transmitting device to transmit a first alarm signal in a case that both the submerging alarm instruction and the distance information instruction are generated.

BRIEF DESCRIPTION OF THE DRAWINGS

In order to clearly illustrate the technical solution of the embodiments of the disclosure, the drawings used in the description of the embodiments or relevant technologies will be briefly described in the following; it is obvious that the described drawings are only related to some embodiments of the disclosure and thus are not limitative of the disclosure.

DETAILED DESCRIPTION

Figure 1:
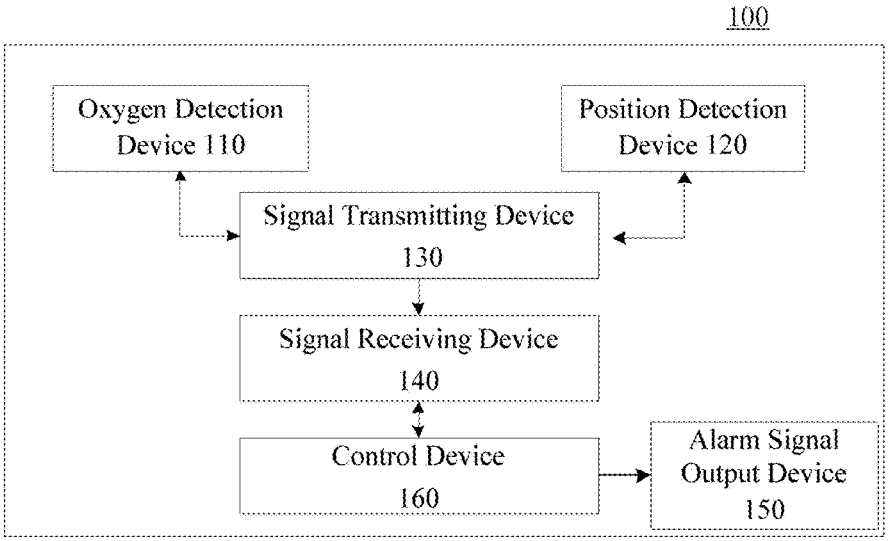
FIG. 1 is an illustrative block diagram of a drowning alarm system provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," and the like, which are used in the description and the claims of the present application for disclosure, are not intended to indicate any sequence, amount or importance, but distinguish various components. Also, the terms such as "a," "an," and etc., are not intended to limit the amount, but indicate the existence of at least one. The terms "comprise," "comprising," "include," "including," and the like, are intended to specify that the elements or the objects stated before these terms encompass the elements or the objects and equivalents thereof listed after these terms, but do not preclude the other elements or objects. The phrases "connect", "connected", and the like, are not intended to define a physical connection or mechanical connection, but can include an electrical connection, directly or indirectly. "On," "under," "right," "left" and the like are only used to indicate relative position relationship, and when the position of the object which is described is changed, the relative position relationship may be changed accordingly.

Embodiments of the present disclosure provide a drowning alarm system and a drowning alarm method, and the drowning alarm system with false alarm prevention function is realized.

At least one embodiment of the present disclosure provides a drowning alarm system, which comprises a submerging detection device, a position detection device and a signal transmitting device. The submerging detection device (e.g., an oxygen detection device) is configured to detect whether or not the submerging detection device is submerged, and generate a submerging alarm instruction (e.g., an oxygen alarm instruction and/or a second oxygen alarm instruction) when the submerging detection device is submerged; the position detection device is configured to determine whether or not the submerging detection device is within a preset range, and generate a distance information instruction when the submerging detection device is within the preset range; and the signal transmitting device is configured to transmit a first alarm signal when the submerging detection device generates the submerging alarm instruction and the position detection device generates the distance information instruction.

For example, according to actual application demands, the submerging detection device can detect whether or not the submerging detection device is submerged based on different principles. No specific limitation will be given here in the embodiment of the present disclosure. For example, the submerging detection device can determine whether or not the submerging detection device is submerged according to a concentration difference of a specific gas in water and air. For example, the concentration of nitrogen (N2) and oxygen (O2) in the air is respectively around 78% and 21%, and the concentration of N2 and O2 dissolved in water is very low (for example, the concentration of N2 and O2 in each liter of water is only a few milligrams), so whether or not a gas detection device (namely the submerging detection device) is submerged in water can be determined by detecting whether or not the gas concentration is less than a certain threshold. For another example, the submerging detection device can also determine whether or not the submerging detection device is submerged according to a pressure difference of water and air on an object in the water and the air or according to a force difference of water and air on an object with fixed surface area in the water and the air. Detailed description will be given below to the drowning alarm system provided by an embodiment of the present disclosure by taking a case that the oxygen detection device is taken as the submerging detection device as an example. But the submerging detection device provided by the present disclosure is not limited to be the oxygen detection device.

For example, FIG. 1 is an illustrative block diagram of a drowning alarm system 100 provided by an embodiment of the present disclosure. As illustrated in FIG. 1, the drowning alarm system 100 comprises an oxygen detection device 110, a position detection device 120 and a signal transmitting device 130.

For example, the oxygen detection device 110 can determine whether or not the oxygen detection device is submerged (e.g., determining whether or not the oxygen detection device 110 is submerged in water at a certain moment or within a certain time period) by detecting an oxygen concentration. For example, the oxygen detection device 110 is configured to detect the oxygen concentration and generate an oxygen alarm instruction (e.g., a submerging alarm instruction) when the oxygen concentration is less than an oxygen threshold. For example, the oxygen detection device 110 can be configured to generate a first oxygen alarm instruction when a total time for a state of the oxygen concentration being less than the oxygen threshold in an oxygen detection period is greater than a first time threshold, and/or generate a second oxygen alarm instruction when a time, for which the oxygen concentration has been continuously less than the oxygen threshold, is greater than a second time threshold. For example, the oxygen detection device 110 in the embodiment of the present disclosure can avoid false alarm caused by non-drowning events such as occasional and/or short-time submerge of the submerging detection device (for example. the oxygen detection device 110) in water and the like. For example, the first oxygen alarm instruction can be an oxygen alarm instruction which indicates that a swimmer is in an earlier drowning stage, and the second oxygen alarm instruction can be an oxygen alarm instruction which indicates that the swimmer is in a later drowning stage. Obviously, according to actual application demands, more types of oxygen alarm instructions can also be set so as to accurately distinguish a current state of a drowning man. Thus, a lifeguard can adjust a rescue strategy according to the current state of the drowning man.

The oxygen detection period, the first time threshold and the second time threshold can be set according to a swimming level of the swimmer. No limitation will be given here in the embodiment of the present disclosure. For example, as for swimming beginners, the first time threshold and the second time threshold can be adequately lowered; and as for swimmers with high swimming level, the first time threshold and the second time threshold can be properly elevated. Thus, the possibility of false alarm events can be further reduced on the premise of ensuring the safety of the swimmer.

For example, as for the swimming beginners, the oxygen detection device 110 can be set to satisfy the following requirements: the oxygen detection device 110 can generate the first oxygen alarm instruction when a total time for a state of the oxygen concentration detected by the oxygen detection device 110 being less than 5% in a time period of 120 seconds is greater than 60 seconds; and/or the oxygen detection device 110 can generate the second oxygen alarm instruction when a total time, for which the oxygen concentration detected by the oxygen detection device 110 has been uninterruptedly less than 5%, is greater than 60 seconds.

For example, as for the swimmers with high swimming level, the oxygen detection device 110 can be set to satisfy the following requirements: the oxygen detection device 110 can generate the first oxygen alarm instruction when a total time for a state of the oxygen concentration detected by the oxygen detection device 110 being less than 5%, in a time period of 180 seconds is greater than 120 seconds; and/or the oxygen detection device 110 can generate the second oxygen alarm instruction when a total time, for which the oxygen concentration detected by the oxygen detection device 110 has been uninterruptedly less than 5%, is greater than 90 seconds.

For example, according to actual application demands, the oxygen detection device 110 can be chemical type oxygen detection device, fiber type oxygen detection device or oxygen detection device based on other suitable detection mechanisms. No limitation will be given here in the embodiment of the present disclosure.

For example, the position detection device 120 is configured to determine whether or not the oxygen detection device 110 is within a preset range, and generate a distance information instruction when the oxygen detection device 110 is within the preset range. For example, the concrete structure and the position detection mechanism of the position detection device 120 can be set according to actual application demands. No specific limitation will be given here in the embodiment of the present disclosure.

Figure 2:
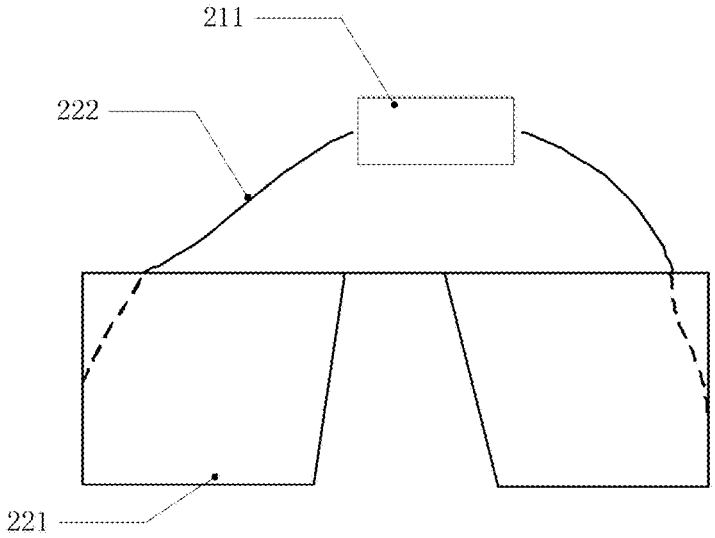
FIG. 2 is a schematic diagram illustrating a method for setting a first position detection sub-device in an embodiment of the present disclosure.
Figure 3:
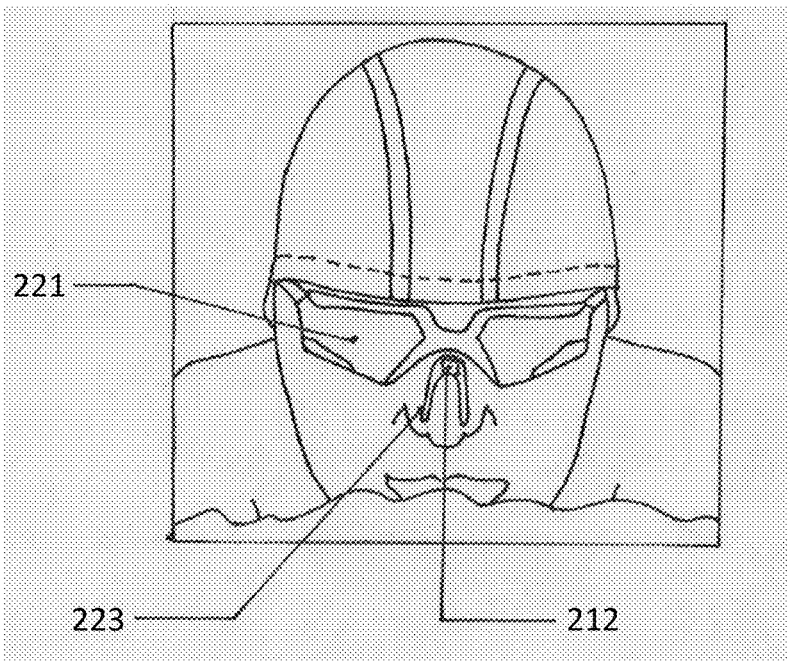
FIG. 3 is a schematic diagram illustrating a method for setting a second position detection sub-device in an embodiment of the present disclosure.

For example, the position detection device 120 can include a first position detection sub-device 211 and a second position detection sub-device 212. For example, the first position detection sub-device 211 can be a Hall-effect detection unit, and the second position detection sub-device 212 can be a magnetic component. For example, the oxygen detection device 110 can be fixedly connected with the first position detection sub-device 211 or the second position detection sub-device 212 (e.g., the first position detection sub-device 211). For example, the fixed connection can be realized by suitable encapsulation or a cable. For example, the first position detection sub-device 211 can be disposed on a swimming goggle 221 (for example, the first position detection sub-device 211 can be disposed on a swimming goggle headband 222 illustrated in FIG. 2), and the second position detection sub-device 212 can be disposed on a nose clip 223 (as illustrated in FIG. 3). For example, the position detection device 120 can be configured to determine a distance between the magnetic component and the Hall-effect detection unit (and the oxygen detection device 110 fixedly connected with the Hall-effect detection unit) according to a magnetic field intensity detected by the Hall-effect detection unit, and then whether or not the oxygen detection device 110 is within the preset range can be determined. For example, according to actual application demands, the preset range can indicate a setting position of the oxygen detection device 110 (e.g., a predetermined setting position or mounting position of the oxygen detection device 110). For another example, the preset range can also indicate a region within a certain range (e.g., 30 cm) of the setting position of the oxygen detection device 110.

For example, the position detection device 120 can be further configured to send a detection signal to the oxygen detection device at set intervals, and determine whether or not the oxygen detection device 110 is within the preset range according to the fact that whether or not a return signal can be received within a preset detection time. For example, the position detection device 120 can include a signal source and a detector; the signal source can be one or a combination of a light-emitting diode (LED), a laser diode, a sound generator and an underwater transducer; and the detector can be one or a combination of a photo sensor and an acoustical detector. For example, the position detection device 120 can be fixed on a swimming cap; the oxygen detection device 110 can be provided on a swimming goggle headband 222; and a signal transmitting plane and a signal receiving plane of the position detection device 120 are arranged towards the oxygen detection device 110. For example, in a case that the oxygen detection device 110 is within the preset range, a signal emitted by the signal source of the position detection device 120 can be incident onto and reflected by the oxygen detection device 110, and then the reflected signal can be incident onto the signal receiving plane of the detector of the position detection device 120 within the preset detection time, and hence whether or not the oxygen detection device 110 is within the preset range can be determined. For another example, in a case that the oxygen detection device 110 is not within the preset range, the signal emitted by the signal source of the position detection device 120 cannot be incident onto the oxygen detection device 110, or cannot return to the signal receiving plane of the detector within the preset detection time. Therefore, whether or not the oxygen detection device 110 is within the preset range can be determined.

For example, the position detection device 120 can be further configured to be in a working mode when the oxygen detection device 110 generates the oxygen alarm instruction. In such a case, because the position detection device 120 is in the working mode only when the oxygen detection device 110 generates the oxygen alarm instruction, the power consumption of the drowning alarm system 100 can be reduced.

For example, the position detection device 120 can be further configured to determine whether or not the oxygen detection device 110 is within the preset range at set intervals (i.e., perform determination of whether or not the oxygen detection device 110 is within the preset range periodically). In such a case, whether or not the oxygen detection device 110 is within the preset range can also be detected in a case of non-drowning event. Thus, the system can warn the swimmer of the dropping of the oxygen detection device 110 when the oxygen detection device 110 is out of the preset range, prevent the swimmer from keeping on swimming in a case of lacking safety measure, and hence the safety of the drowning alarm system 100 provided by the embodiment of the present disclosure can be further improved.

For example, the interval (i.e., time interval) can be set according to actual application demands, and is not limited in the embodiment of the present disclosure. For example, the time interval can be set to be a fixed value (e.g., 10 minutes). For another example, the time interval can also be set to change according to a detection result of the oxygen detection device 110. For example, when the oxygen alarm instruction is not generated (for example, when the oxygen alarm instruction is not generated during a predetermined time period such as 30 minutes before the current time interval setting), the time interval can be set to be 20 minutes; and when the oxygen alarm instruction is generated, the time interval is shortened to be 30 seconds. Thus, the power consumption of the position detection device 120 can be reduced while the safety of the drowning alarm system 100 is improved.

For example, the signal transmitting device 130 can be configured to transmit a first alarm signal when the oxygen detection device 110 generates the oxygen alarm instruction and the position detection device 120 generates the distance information instruction. For example, when the swimmer is experiencing a drowning event and the oxygen detection device 110 does not drop off, the oxygen detection device 110 is submerged in water continuously or submerged in water discontinuously for a long period of time, so that the oxygen detection device 110 can generate the oxygen alarm instruction. In addition, as the oxygen detection device 110 does not drop off, the position detection device 120 generates the distance information instruction. Thus, in this case, the signal transmitting device 130 transmits the first alarm signal. For another example, when the swimmer and the oxygen detection device 110 are occasionally submerged in water (for example, the swimmer plays with companions), as the total time for a state of the oxygen concentration being less than the oxygen threshold in the oxygen detection period, is less than the first time threshold, and the time, for which the oxygen concentration has been continuously less than the oxygen threshold, is less than the second time threshold, the oxygen detection device 110 dose not generate the oxygen alarm instruction, so the signal transmitting device 130 dose not transmit the first alarm signal. For further another example, when the oxygen detection device drops off or is removed by the swimmer, the oxygen detection device 110 generates the oxygen alarm instruction. However, as the position detection device 120 determines that the oxygen detection device 110 is out of the preset range, the position detection device 120 does not generate the distance information instruction, so the signal transmitting device 130 does not transmit the first alarm signal. Thus, the drowning alarm system 100 can realize false alarm prevention function (e.g., false alarm caused by the dropping of the oxygen detection device).

For example, the first alarm signal can be an alarm signal indicating a drowning event. For example, the first alarm signal can include information about the current state of the drowning man (e.g., in the earlier or later drowning stage, or the drowning time), so the current state of the drowning man can be accurately distinguished, and hence the lifeguard can adjust the rescue strategy according to the current state of the drowning man.

For example, the signal transmitting device 130 can be further configured to transmit a second alarm signal when the oxygen detection device 110 is out of the preset range. The second alarm signal can be an alarm signal for warning the swimmer of the dropping of the oxygen detection device 110, so as to prevent the swimmer from keeping on swimming in the case of lacking safety measure. Thus, the safety of the drowning alarm system 100 can be improved.

For example, according to actual application demands, a carrier wave of the first alarm signal and/or the second alarm signal transmitted by the signal transmitting device 130 can be one or a combination of sound waves, light in blue green wavelength range and low-frequency electromagnetic waves. The signal source in the signal transmitting device 130 can be set according to actual application demands, and is not limited in the embodiment of the present disclosure. For example, the signal transmitting device 130 can include an underwater transducer capable of transmitting sound waves. For another example, the signal transmitting device 130 can include a laser diode capable of emitting blue green laser signals, and a LED capable of emitting blue green light. As the attenuation of the carrier waves in water is relatively small, the volume, the weight and the power consumption of the signal transmitting device 130 can be reduced, so the use experience of the swimmer can be accordingly enhanced.

For example, the signal transmitting device 130 can include a control unit. The control unit can be an advanced RISC machine (ARM) system, a field programmable gate array (FPGA) or other system-on-a-chips (SoCs).

For example, the information and instruction transmission between the oxygen detection device 110 and the position detection device 120 and the signal transmitting device 130 can be realized by a cable or wireless signals. For example, when the signal transmitting device 130, the first position detection sub-device 211 and the oxygen detection device 110 are packaged together, the signal transmitting device 130 can be electrically connected with the first position detection sub-device 211 and the oxygen detection device 110 through a cable, so as to realize the transmission of information and instructions. For example, carrier waves of the wireless signals can adopt carrier waves with low attenuation coefficient in water, e.g., sound waves, light in blue green wavelength range and low-frequency electromagnetic waves.

For example, the drowning alarm system 100 can further comprise a signal receiving device 140. The signal receiving device 140 is configured to receive the alarm signal (e.g., the first alarm signal) transmitted by the signal transmitting device 130. The signal receiving device 140 includes a detector. The type of the detector can be set according to the type of the signal source in the signal transmitting device 130. For example, when the signal transmitting device 130 includes the laser diode capable of emitting blue green laser signals, the detector in the signal receiving device 140 can be a photo sensor capable of detecting electromagnetic waves in blue green wavelength range. For another example, when the signal transmitting device 130 includes the underwater transducer capable of emitting acoustic signals, the detector in the signal receiving device 140 can be an acoustical detector capable of detecting acoustic signals.

Figure 4:
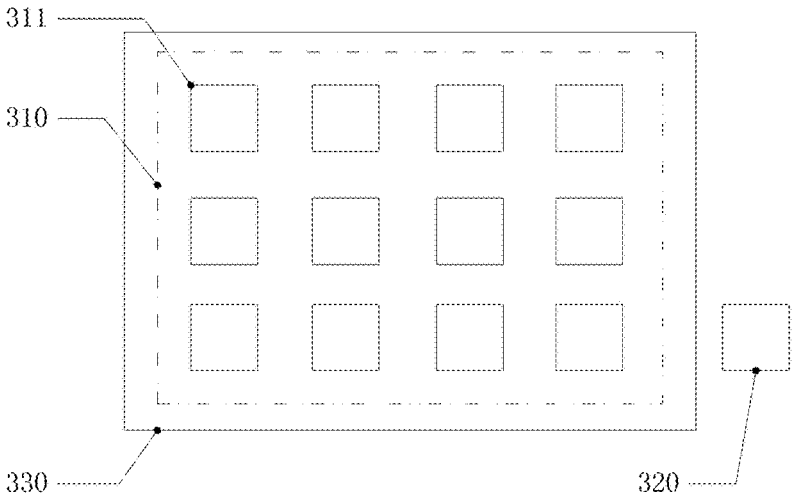
FIG. 4 is a schematic diagram illustrating a method for setting a signal receiving device in an embodiment of the present disclosure.

For example, in order to locate a position of the drowning man, the signal receiving device 140 can include a first signal receiving sub-device 310 (for example, detector) and a second signal receiving sub-device 320 (for example, detector), as illustrated in FIG. 4. The first signal receiving sub-device 310 can include a plurality of sensing units 311 (e.g., a plurality of sensing units arranged in an array). The signal transmission between the sensing units 311 and the second signal receiving sub-device 320, and the signal transmission between the plurality of sensing units 311 can be set according to actual application demands, and is not limited in the embodiment of the present disclosure. For example, the plurality of sensing units 311 can be uniformly disposed in a swimming pool 330 (e.g., the bottom and four side walls of the swimming pool 330). For example, the second signal receiving sub-device 320 can be disposed at the outside of the swimming pool 330 (for example, disposed at one side of the swimming pool 330). For example, the signal transmission between the plurality of sensing units 311 can be realized through wireless communication or wired communication. For example, the signal transmission between at least one sensing unit 311 and the second signal receiving sub-device 320 can be realized through wireless communication or wired communication.

For example, the drowning alarm system 100 can further comprise a control device 160, and the second signal receiving sub-device 320 can relay the signals received (i.e., the first alarm signal received and transmitted by the plurality of sensing units 311 of the first signal receiving sub-device 310) to the control device 160 by wired or wireless communication. The control device 160 can determine a position of the oxygen detection device 110 and the drowning man according to intensities of the first alarm signal received by the plurality of sensing units 311 of the first signal receiving sub-device 310. The concrete determination method of the position of the oxygen detection device 110 and the drowning man can refer to passive target positioning technology based on an underwater sensor network. No further description will be given herein.

For example, the control device 160 can include a processor and a memory. The processor, for example, is a central processing unit (CPU) or a processing unit in other forms having data processing capability and/or instruction execution capability. For example, the processor can be implemented as a general-purpose processor, and can also be microcomputer, a microprocessor, a digital signal processor (DSP), a special-purpose image processing chip, a field programmable logic array (FPLA), and the like. The memory, for example, can include a volatile memory and/or a nonvolatile memory, and for example, can include a read-only memory (ROM), a hard disk, a flash memory, and the like. Correspondingly, the memory can be implemented as one or a plurality of computer program products. The computer program products can include computer readable storage media in various forms. One or a plurality of computer program instructions can be stored in the computer-readable storage medium. The processor can run the program instructions to determine the position of the oxygen detection device 110 and the drowning man. The processor can also realize the functions of the control device 160 in the embodiment of the present disclosure described below and/or other desired functions. The memory can also store various kinds of application programs and various kinds of data, e.g., alarm information data, and various kinds of data applied to and/or generated by application programs.

For example, the control device 160 can be a special-purpose device (e.g., a special-purpose desk computer), and can also utilize the existing device of a natatorium and/or the lifeguard. For example, a mobile phone of the lifeguard can be adopted as the control device 160.

Figures 5, 6:
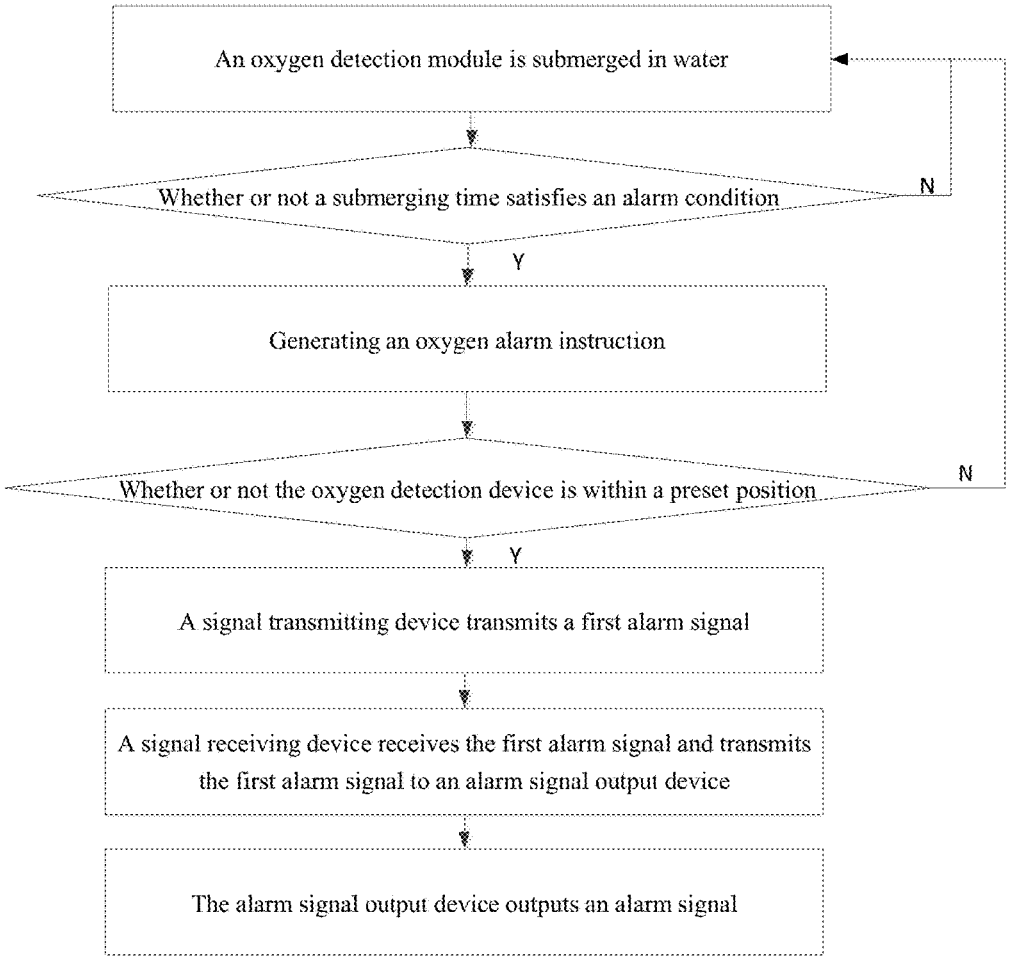
FIG. 5 is a schematic diagram illustrating a composition of an alarm signal in an embodiment of the present disclosure.
FIG. 6 is an illustrative flow diagram illustrating signal transmission of the drowning alarm system provided by an embodiment of the present disclosure.

For example, the drowning alarm system 100 can further comprise an alarm signal output device 150. The alarm signal output device 150 is configured to output alarm information. For example, a carrier of the alarm information can be one or a combination of voice, character, optical signals and mechanical vibration. For example, the carrier of the alarm information can be voice outputted from the loudspeaker. For another example, the carrier of the alarm information can be flashing emitted by a risk warning lamp. For further another example, the carrier of the alarm information can be a mechanical vibration of a bracelet worn by the lifeguard. For example, the alarm signal can be outputted through a special-purpose device, and can also be outputted by the existing device of the natatorium and/or the lifeguard. For example, an audio alarm signal or a light alarm signal can be outputted by the existing sound system or the risk warning lamp of the natatorium. For another example, at least one type of alarm signal selected from an audio alarm signal, a character alarm signal or a vibration alarm signal can be outputted by utilization of at least one of a tablet PC, a mobile phone or a bracelet of the lifeguard. According to the alarm signal output device 150 arranged for the drowning alarm system 100, the alarm signal, for example, can only include information to warn the lifeguard that a drowning event is occurred. The alarm signal can also include the position information of the drowning man, the drowning state information of the drowning man, and personal information (e.g., age, sex and weight) of the drowning man. For example, the alarm signal can be in the form as illustrated in FIG. 5, and the alarm signal can include the identifier (e.g., the first three digits of the alarm signal) of the sensing unit 311 and the identifier (e.g., the last two digits of the alarm signal, 01 indicates an occurrence of a drowning event, and 02 indicates an occurrence of a dropping off event of the oxygen detection device) of the alarm type. For example, according to actual conditions, the alarm signal output device 150 not only can output the identifier of the alarm signal but also can output language or text corresponding to the alarm signal, in a case of outputting the alarm signal. No specific limitation will be given herein.

FIG. 6 is an illustrative flow diagram illustrating signal transmission of the drowning alarm system provided by an embodiment of the present disclosure. As illustrated in FIG. 6, when the oxygen detection module is submerged in the water and the submerging time satisfies an alarm condition, the oxygen detection module generates the oxygen alarm instruction; the oxygen alarm instruction allows the position detection device to be in the working mode, and the position detection device detects whether or not the oxygen detection module is within the preset range; when the oxygen detection module is within the preset range, the signal transmitting device transmits the first alarm signal; subsequently, the signal receiving device receives the first alarm signal and send the first alarm signal to the alarm output device; and finally, the alarm output device outputs the alarm signal. Obviously, the flow diagram illustrating the signal transmission of the drowning alarm system as illustrated in FIG. 6 is only an example, the flow diagram illustrating the signal transmission of the drowning alarm system can be different from FIG. 6. No further description will be given herein.

At least one embodiment of the present disclosure provides a drowning alarm method, which comprises: detecting whether or not the submerging detection device is submerged, and generating a submerging alarm instruction when the submerging detection device is submerged; determining whether or not the submerging detection device is within a preset range, and generating a distance information instruction when the submerging detection device is within the preset range; and transmitting a first alarm signal in a case that both the submerging alarm instruction and the distance information instruction are generated.

For example, according to actual application demands, the submerging detection device can detect whether or not the submerging detection device is submerged on the basis of different principles. No specific limitation will be given here in the embodiment of the present disclosure. For example, the submerging detection device can determine whether or not the submerging detection device is submerged according to a concentration difference of a specific gas in water and air. For another example, the submerging detection device can also determine whether or not the submerging detection device is submerged according to a pressure difference of water and air on an object in the water and the air or according to a force difference of water and air on an object with fixed surface area in the water and the air. Detailed description will be given below to the drowning alarm method provided by another embodiment of the present disclosure by taking a case that the oxygen detection device is taken as the submerging detection device as an example. But the submerging detection device in another embodiment of the present disclosure is not limited to be the oxygen detection device.

Figure 7:
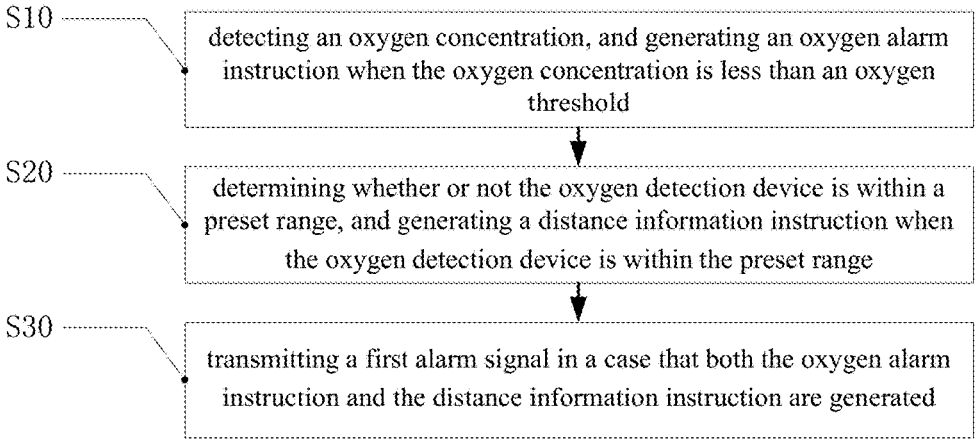
FIG. 7 is a flow diagram of a drowning alarm method provided by another embodiment of the present disclosure.

FIG. 7 is a flow diagram of the drowning alarm method provided by another embodiment of the present disclosure. As illustrated in FIG. 7, the drowning alarm method can comprise the following steps:

S10: detecting an oxygen concentration, and generating an oxygen alarm instruction when the oxygen concentration is less than an oxygen threshold;

S20: determining whether or not the oxygen detection device is within a preset range, and generating a distance information instruction when the oxygen detection device is within the preset range; and S30: transmitting a first alarm signal in a case that both the oxygen alarm instruction and the distance information instruction are generated.

For example, in the step S10, the step of detecting the oxygen concentration and generating the oxygen alarm instruction when the oxygen concentration is less than the oxygen threshold can include: generating a first oxygen alarm instruction when a total time for a state of the oxygen concentration being less than the oxygen threshold in an oxygen detection period is greater than a first time threshold; and/or generating a second oxygen alarm instruction when a time, for which the oxygen concentration has been continuously less than the oxygen threshold, is greater than a second time threshold. The settings of the oxygen detection period, the first time threshold and the second time threshold can refer to the embodiment of the drowning alarm system, so no further description will be given herein. For example, the first oxygen alarm instruction can be an oxygen alarm instruction which indicates that a swimmer is in an earlier drowning stage, and the second oxygen alarm instruction can be an oxygen alarm instruction which indicates that the swimmer is in a later drowning stage. Obviously, according to actual application demands, more types of oxygen alarm instructions can also be set so as to accurately distinguish a current state of a drowning man. Thus, a lifeguard can adjust a rescue strategy according to the current state of the drowning man.

For example, in the step S20, a detection mechanism for determining whether or not the oxygen detection device is within the preset range can be based on Hall-effect ranging mechanism, laser or sound ranging mechanism or other suitable ranging mechanisms. The principle and the method of determining whether or not the oxygen detection device is within the preset range through the Hall-effect ranging mechanism or the laser or sound ranging mechanism can refer to the embodiment of the drowning alarm system. No further description will be given herein. For example, the step S20 can be executed only in a case that the oxygen alarm instruction is generated, so as to reduce the power consumption of the system based on the drowning alarm method. For another example, the step S20 can also be executed once per time period, such that the swimmer can be warned when the oxygen detection device drops off. Thus, the safety of the drowning alarm method can be improved. For example, the time period can also be set to change according to a detection result of the oxygen concentration. For example, when the oxygen alarm instruction is not generated, the time period can be set to be 20 mins; and when the oxygen alarm instruction is generated, the time period can be shortened to be 30 s. Thus, the power consumption of the system based on the drowning alarm method can be reduced while the safety is improved.

For example, in the step S30, the first alarm signal can be an alarm signal indicating that a drowning event is occurred. For example, the first alarm signal can include information about the current state of the drowning man (e.g., in the earlier or later drowning stage, or the drowning time), so the current state of the drowning man can be accurately distinguished, and hence the lifeguard can adjust the rescue strategy according to the current state of the drowning man.

For example, the following three cases can be experienced by the swimmer during swimming: (1) when the swimmer is experiencing a drowning event and the oxygen detection device does not drop off, the oxygen detection device is submerged in water continuously or submerged in water discontinuously for a long period of time, so that the oxygen detection device can generate the oxygen alarm instruction; in addition, as the oxygen detection device does not drop off, the distance information instruction is generated; and in this case, the first alarm signal is transmitted; (2) when the swimmer and the oxygen detection device are occasionally submerged in water, as the submerging time (for example, the total submerging time in the oxygen detection period) is short, the oxygen detection device does not generate the oxygen alarm instruction, so the first alarm signal is not transmitted; and (3) when the oxygen detection device drops off or is removed by the swimmer, the oxygen detection device generates the oxygen alarm instruction, but the position detection device dose not generate the distance information instruction, so the first alarm signal is not transmitted. Thus, the drowning alarm method can realize false alarm prevention function.

For example, the drowning alarm method can further comprise: transmitting a second alarm signal when the oxygen detection device is out of the preset range. The second alarm signal can be an alarm signal for warning the swimmer of the dropping of the oxygen detection device, so as to prevent the swimmer from keeping on swimming in a case of lacking safety measure. Thus, the safety of the drowning alarm method can be improved.

For example, the drowning alarm method can further comprise: receiving the first alarm signal, and outputting alarm information in a case that the first alarm signal is transmitted (for example, transmitted by a signal transmitting device) or in a case that the first alarm signal is received (for example, received by a signal receiving device). The carrier of the alarm information can be one or a combination of voice, character, optical signals and mechanical vibration. The device for outputting the alarm signal and the information conveyed by the alarm signal can refer to the embodiment of the drowning alarm system. No further description will be given herein.

For example, the drowning alarm method can further comprise: determining a position of the drowning man according to intensities of the first alarm signal received. The specific determination method of the position of the drowning man can refer to passive target positioning technology based on an underwater sensor network. No further description will be given here.

At least one embodiment of the present disclosure provides a drowning alarm system. The drowning alarm system comprises a submerging detection device, a position detection device, a signal transmitting device, a processor, a memory and computer program instructions stored in the memory. The following steps are executed when the processor runs the computer program instructions: detecting whether or not the submerging detection device is submerged, and generating a submerging alarm instruction when the submerging detection device is submerged; determining whether or not the submerging detection device is within a preset range, and generating a distance information instruction when the submerging detection device is within the preset range; and adopting the signal transmitting device to transmit a first alarm signal in a case that both the submerging alarm instruction and the distance information instruction are generated. For example, the drowning alarm system realizes a false alarm prevention function.

Embodiments of the present disclosure provide a drowning alarm system and a drowning alarm method, and the drowning alarm system with false alarm prevention function is realized.

What are described above is related to the illustrative embodiments of the disclosure only and not limitative to the scope of the disclosure; the scopes of the disclosure are defined by the accompanying claims.

The application claims priority to the Chinese patent application No. 201710009887.4, filed Jan. 6, 2017, the entire disclosure of which is incorporated herein by reference as part of the present application.

What is claimed is:

1. A drowning alarm system, comprising:

a submerging detection device configured to detect whether or not the submerging detection device is submerged, and generate a submerging alarm instruction when the submerging detection device is submerged;

a position detection device configured to determine whether or not the submerging detection device is within a preset range, and generate a distance information instruction when the submerging detection device is within the preset range; and a signal transmitting device configured to transmit a first alarm signal when the submerging detection device generates the submerging alarm instruction and the position detection device generates the distance information instruction.

2. The drowning alarm system according to claim 1, wherein detecting of whether or not the submerging detection device is submerged and generating of the submerging alarm instruction when the submerging detection device is submerged comprises:

generating a first submerging alarm instruction when a total time for a state of the submerging detection device being submerged in a submerging detection period is greater than a first time threshold; and/or generating a second submerging alarm instruction when a time, for which the submerging detection device has been continuously submerged, is greater than a second time threshold.

3. The drowning alarm system according to claim 1, wherein the position detection device is further configured to be in a working mode when the submerging detection device generates the submerging alarm instruction.

4. The drowning alarm system according to claim 1, wherein the position detection device is further configured to determine whether or not the submerging detection device is within the preset range at set intervals.

5. The drowning alarm system according to claim 1, wherein the position detection device comprises a first position detection sub-device and a second position detection sub-device;

the submerging detection device is fixedly connected with the first position detection sub-device or the second position detection sub-device; and the position detection device is configured to determine whether or not the submerging detection device is within the preset range according to a distance between the first position detection sub-device and the second position detection sub-device.

6. The drowning alarm. system according to claim 5, further comprising a swimming goggle and a nose clip, wherein the first position detection sub-device is disposed on the swimming goggle; and the second position detection sub-device is disposed on the nose clip.

7. The drowning alarm system according to claim 1, wherein the signal transmitting device is further configured to transmit a second alarm signal when the submerging detection device is out of the preset range.

8. The drowning alarm system according to claim 1, further comprising a signal receiving device, wherein the signal receiving device is configured to receive the first alarm signal.

9. The drowning alarm system according to claim 8, wherein the signal receiving device comprises a first signal receiving sub-device and a second signal receiving sub-device;

the first signal receiving sub-device comprises a plurality of sensing units; and signal transfer between at least one sensing unit and the second signal receiving sub-device is realized through wireless communication or wired communication.

10. The drowning alarm system according to claim 9, further comprising a control device, wherein the plurality of sensing units are arranged in an array; and the second signal receiving sub-device receives a signal transmitted by the at least one sensing unit, and relays the signal received to the control device.

11. The drowning alarm system according to claim 9, further comprising a control device, wherein the control device is configured to determine a position of the submerging detection device according to intensities of the first alarm signal received by the plurality of sensing units of the first signal receiving sub-device.

12. The drowning alarm system according to claim 1, further comprising an alarm signal output device, wherein the alarm signal output device is configured to output alarm information.

13. The drowning alarm system according to claim 1, wherein the position detection device is configured to determine whether or not the submerging detection device is within the preset range by determining a distance between at least a portion of the position detection device and the submerging detection device.

14. A drowning alarm method, comprising:

detecting whether or not the submerging detection device is submerged, and generating a submerging alarm instruction when the submerging detection device is submerged;

determining whether or not the submerging detection device is within a preset range, and generating a distance information instruction when the submerging detection device is within the preset range; and transmitting a first alarm signal in a case that both the submerging alarm instruction and the distance information instruction are generated.

15. The method according to claim 14, wherein detecting of whether or not the submerging detection device is submerged and generating of the submerging alarm instruction when the submerging detection device is submerged comprises:

generating a first submerging alarm instruction when a total time for a state of the submerging detection device being submerged in a submerging detection period is greater than a first time threshold; and/or generating a second submerging alarm instruction when a time, for which the submerging detection device has been continuously submerged, is greater than a second time threshold.

16. The method according to claim 14, wherein whether or not the submerging detection device is within the preset range is determined when the submerging detection device generates the submerging alarm instruction.

17. The method according to claim 14, further comprising:

transmitting a second alarm signal when the submerging detection device is out of the preset range.

18. The method according to claim 14, further comprising:

receiving the first alarm signal, and determining a position of a drowning man according to intensities of the first alarm signal received.

19. The method according to claim 14, further comprising:

outputting alarm information in a case that the first alarm signal is transmitted.

20. A drowning alarm system, comprising a submerging detection device, a position detection device, a signal transmitting device, a processor, a memory and computer program instructions stored in the memory, wherein upon the processor running the computer program instructions, the drowning alarm system performs the following method comprising:

detecting whether or not the submerging detection device is submerged, and generating a submerging alarm instruction when the submerging detection device is submerged;

determining whether or not the submerging detection device is within a preset range, and generating a distance information instruction when the submerging detection device is within the preset range; and adopting the signal transmitting device to transmit a first alarm signal in a case that both the submerging alarm instruction and the distance information instruction are generated.

* * * * *